US005855527A

United States Patent [19]

Koole

[11] Patent Number: 5,855,527

[45] Date of Patent: Jan. 5, 1999

[54] GAME NET POST

[75] Inventor: Peter Marinus Koole, Kloetinge, Netherlands

[73] Assignee: Schelde International B.V., Netherlands

[21] Appl. No.: 904,471

[22] Filed: Aug. 1, 1997

[51] Int. Cl.[6] ..... A61B 61/02

[52] U.S. Cl. ..... 473/493

[58] Field of Search ..... 473/492, 493, 473/494, 495, 483

[56] References Cited

U.S. PATENT DOCUMENTS

| | | | |
|---|---|---|---|
| 3,065,964 | 11/1962 | Barnes | 473/493 |
| 5,215,310 | 6/1993 | Allbright | 273/411 |
| 5,308,085 | 5/1994 | Koole | 273/411 |

*Primary Examiner*—William H. Grieb
*Attorney, Agent, or Firm*—Brooks & Kushman P.C.

[57] ABSTRACT

A game net post adapted to be placed in substantially vertical position into the ground or floor, the post being provided with mechanism for attaching a net and for tensioning a net cable, the cross-sectional profile of the post presenting a cavity, open to the outside, and having cross-sectional dimensions such that the net cable tensioning mechanism may be received and substantially housed within it. Preferably, in the cavity, a longitudinal member is slideably inserted and which has affixed to it the net cable tensioning mechanism. The tensioning mechanism may comprise devices carrying a wire shaft and a handle coupled to the wire shaft, adapted to rotate the wire shaft while avoiding the longitudinal displacement thereof, a running nut with a hook device being associated with the wire shaft. A second embodiment is a two-part height-adjustable post. The two post parts have cross-sectional profiles such that the second one is slideable within the first one of such parts, the cross-sectional profile of each of the post parts presents a cavity, open to the outside, and having cross-sectional dimensions such that the net cable tensioning mechanism may be received in it. Also with this embodiment a longitudinal member is preferably inserted which is affixed to one post part and is slideable within the cavity in the other post part, the longitudinal member having affixed to it the net cable tensioning mechanism.

14 Claims, 9 Drawing Sheets

GAME NET POST

BACKGROUND OF THE INVENTION

State of the Art

The invention relates to a game net post adapted to be placed in substantially vertical position in the ground or floor, and being provided with means for attaching a net and for tensioning a net cable.

Net posts for games such as volleybal have been known in a great many embodiments. Examples are found in U.S. Pat. No. 5,215,310, granted to Allbright, and U.S. Pat. No. 5,308,085, granted to the present inventor and assigned to the same assignee.

All known game net posts have the means for attaching and tensioning the net cable somehow at the outside of the post proper. This is a hindrance both during storage and set up and during the game because players may be hurt.

OBJECTS OF THE INVENTION

The main object of the invention is to provide a game net post with a minimum of parts projecting outside the circumferential surface of the post proper.

Another object is to provide such a game net post which is easy to manufacture, to mount and to handle in use.

A further object is to provide both a one-part post and a two-part post which is adjustable in height. Although two-part height adjustable game net posts have been known in themselves, the first and second object of the invention should be realized also with a two-part embodiment of the post, despite the complications which the two-part structure entails.

SUMMARY OF THE INVENTION

According to the invention the cross-sectional profile of the post presents a cavity which is open to the outside and which has cross-sectional dimensions such that at least the net cable attachment and tensioning means may be received in it.

A solution for the problem of how to mount said net cable attachment and tensioning means in the cavity in the post, is to provide a longitudinal member which is slideable inside said cavity, the longitudinal member having affixed to it the net cable attachment and tensioning means. There would be means to immobilize said longitudinal member inside the cavity with respect to the post.

Although a simple strip would do as longitudinal member to which the net attachment and tensioning means are affixed, in combination with means which prevent the longitudinal member from leaving the cavity in the post, the invention prefers the outer profile of the longitudinal member to substantially correspond with the inner cross-sectional profile of said cavity.

Also by preference there will be no fixed relationship between the longitudinal member and the post, but the longitudinal member may be slideable inside said cavity, so that the two may be immobilized in a selected relative position, serving to obtain a selected net height.

In the two-part height-adjustable embodiment of the game net post the invention proposes that the two post parts both have cross-sectional profiles such that one is slideable within the other.

Also in this case a longitudinal member may be provided of basically identical construction to the longitudinal member with which the one-part embodiment is made.

SHORT DESCRIPTION OF THE DRAWINGS

Figure 1:
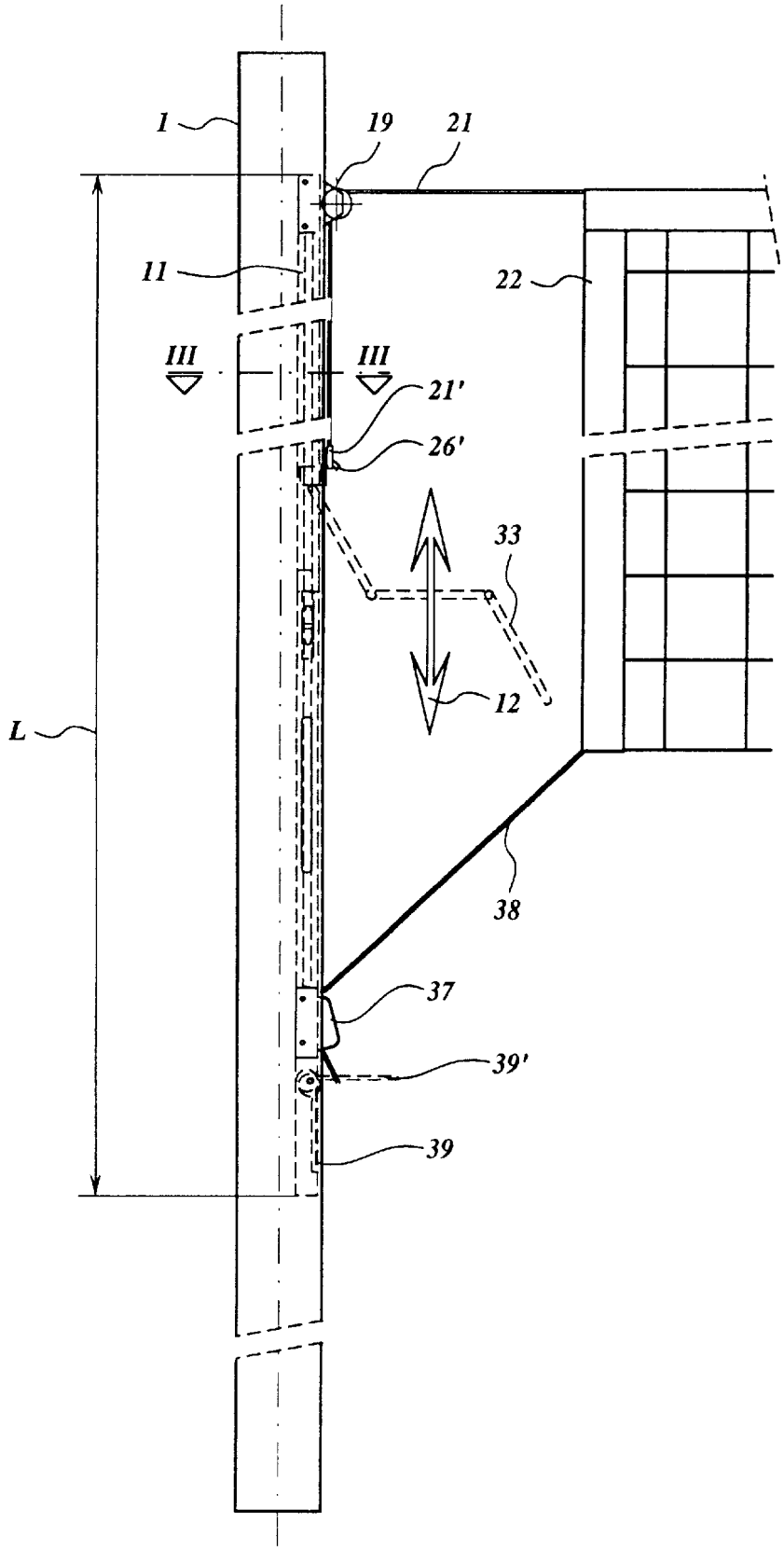
FIG. 1 is a schematic elevational view of a first embodiment, being a one-piece post.
Figure 4A:
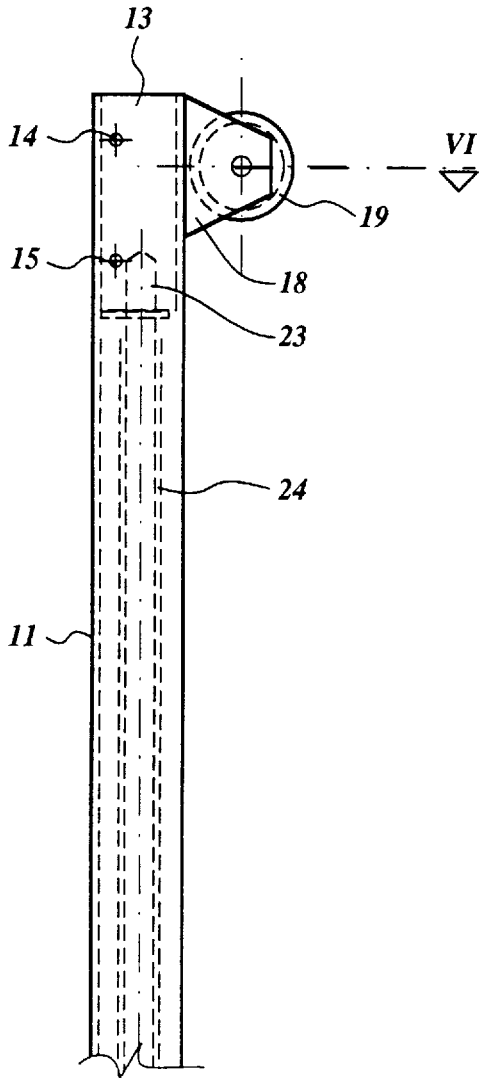
Figure 4B:
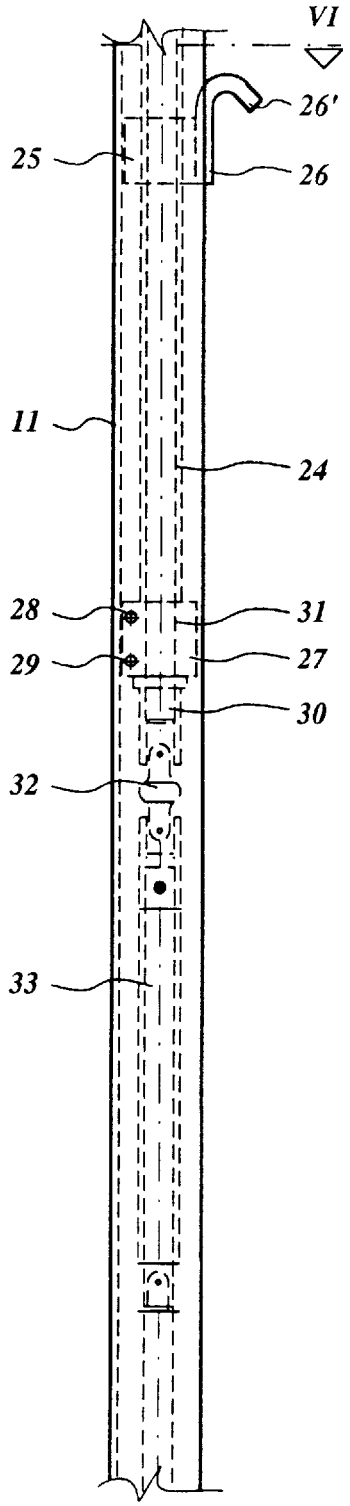
Figure 4C:
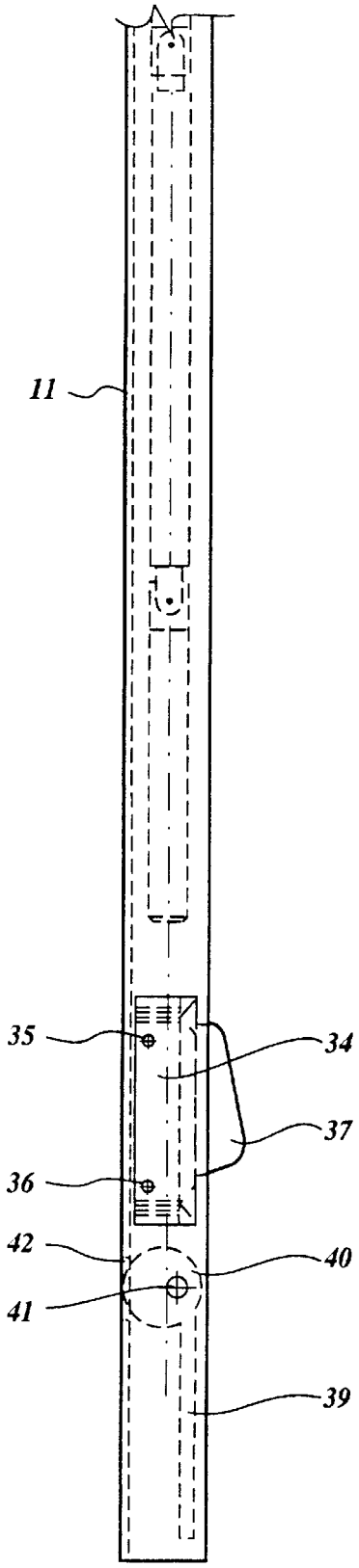

FIG. 4, comprising FIGS. 4A, 4B and 4C, is a schematic elevational view of the longitudinal member with the parts attached to it, on an enlarged scale as compared with FIG. 1.

Figure 5:
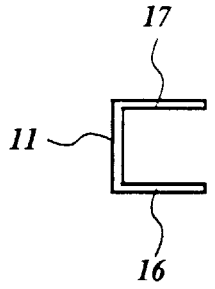

FIG. 5 is an end view of the longitudinal member proper, on the same scale as FIG. 4.

Figure 6:
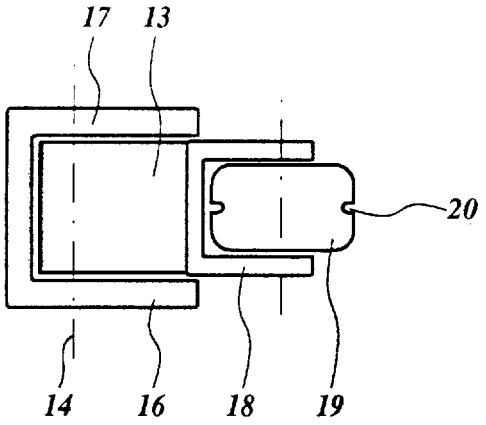

FIG. 6 is a cross-sectional view according to the arrows VI—VI in FIG. 4.

Figure 7:
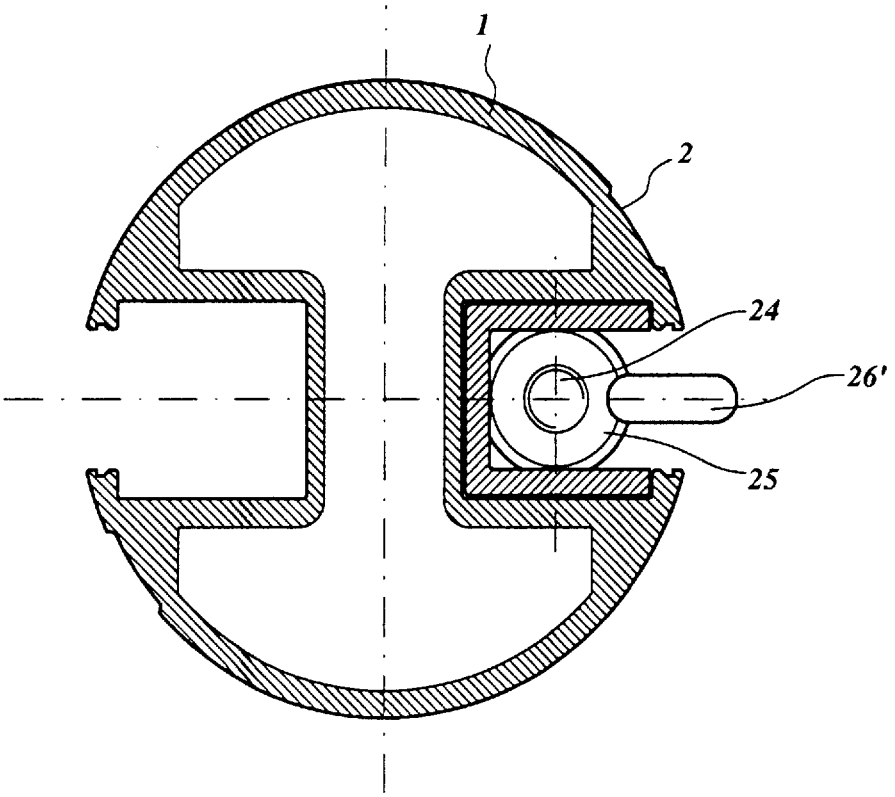

FIG. 7 is a cross-sectional view according to the arrows VII—VII in FIG. 1.

Figure 8A:
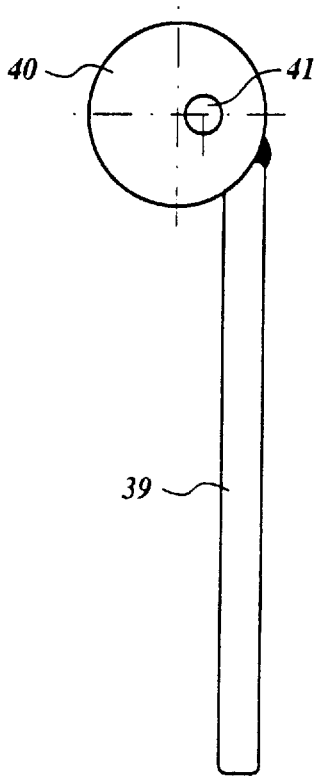
Figure 8B:
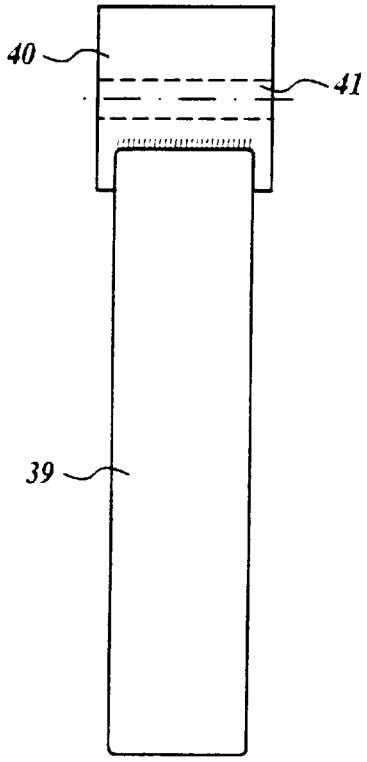

FIGS. 8A and 8B show a clamping handle separately, as a side view and as an elevational view, respectively.

Figure 9:
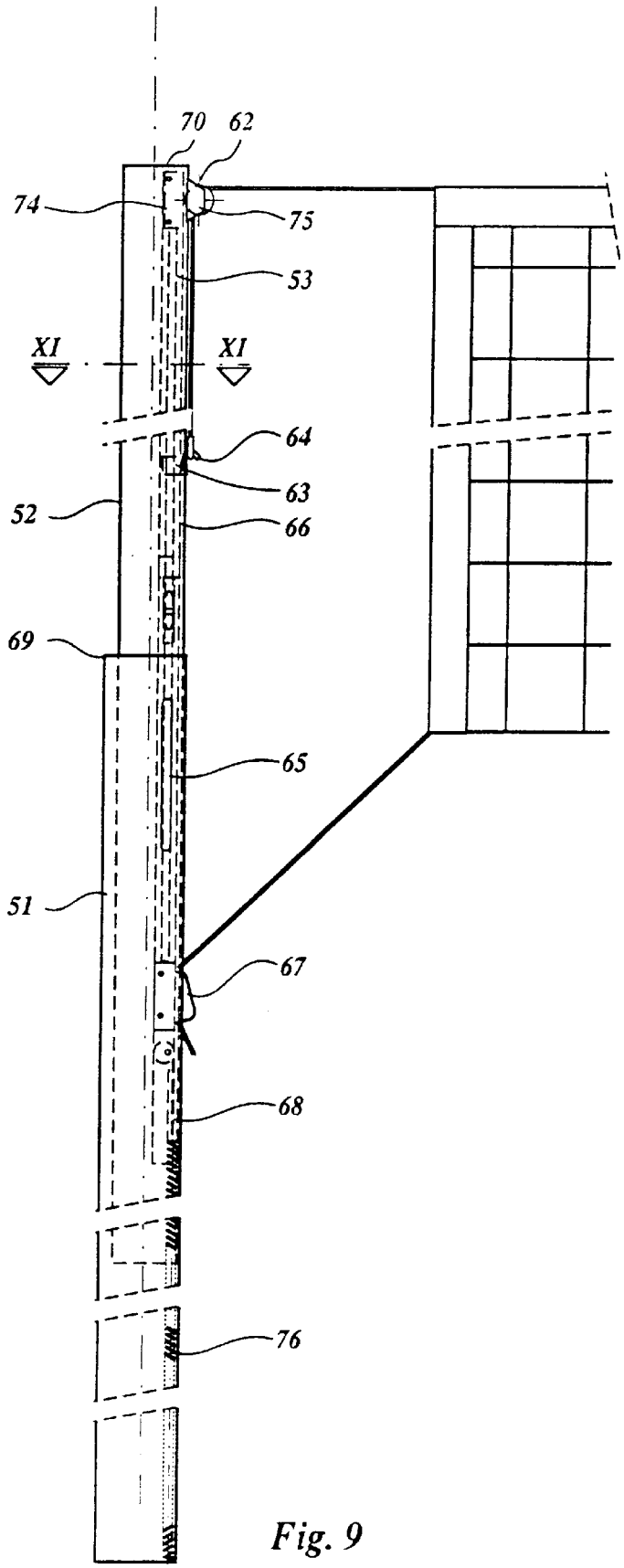
Figure 10:
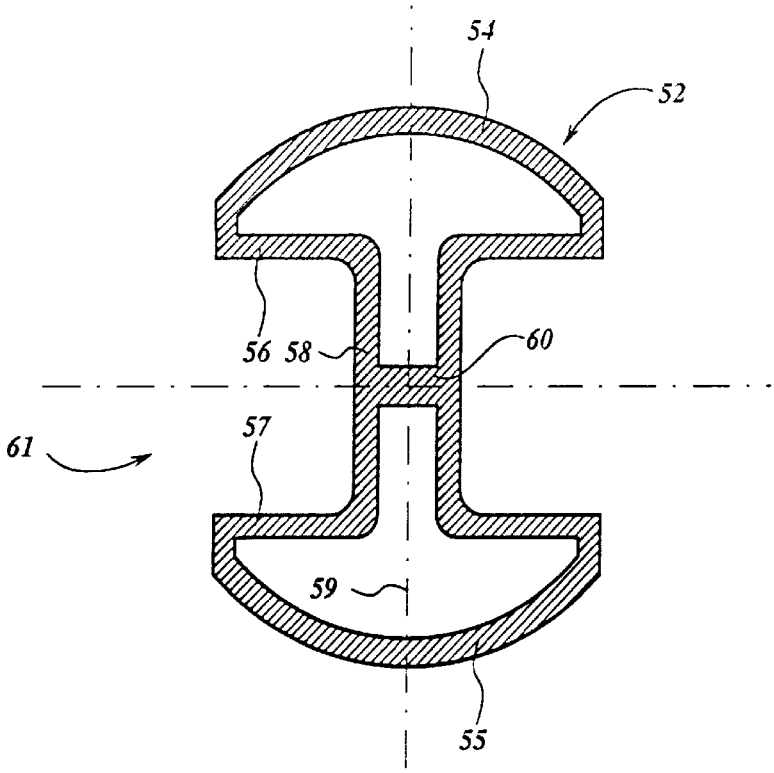

FIG. 9 is a schematic view of the game post in the second embodiment, being a two-part post, FIG. 10 shows the cross-sectional profile of the upper post part.

Figure 11:
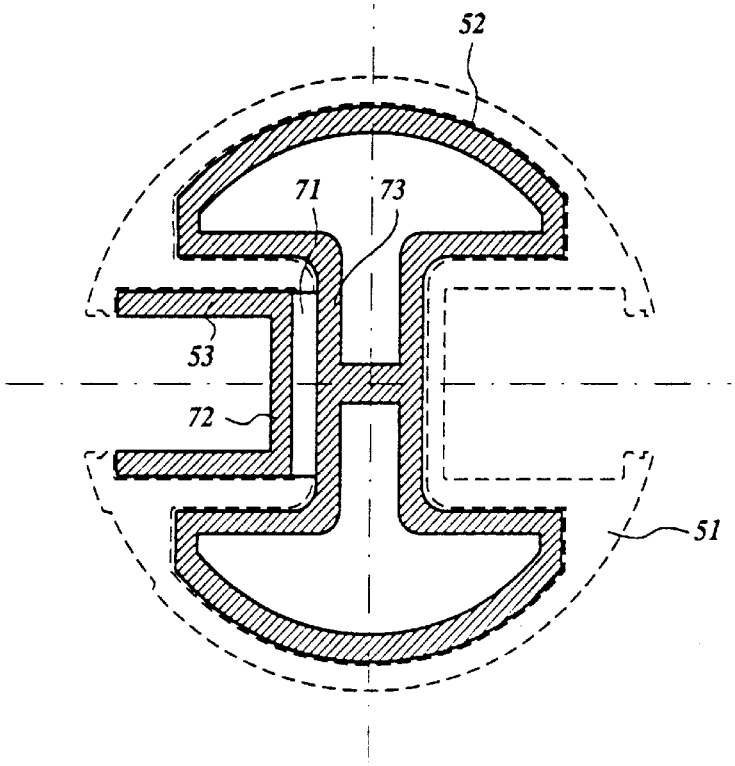

FIG. 11 is a cross-sectional view according to the arrows XI—XI in FIG. 9.

DESCRIPTION OF THE PREFERRED EMBODIMENTS

FIG. 1 is an elevational view of the game post in a first preferred embodiment. The post 1 is adapted to be placed in substantially vertical position into a sleeve or pot arranged in the ground or floor, as is commonly done; therefor these normal facilities in the ground or floor are not shown or described.

Figure 2:
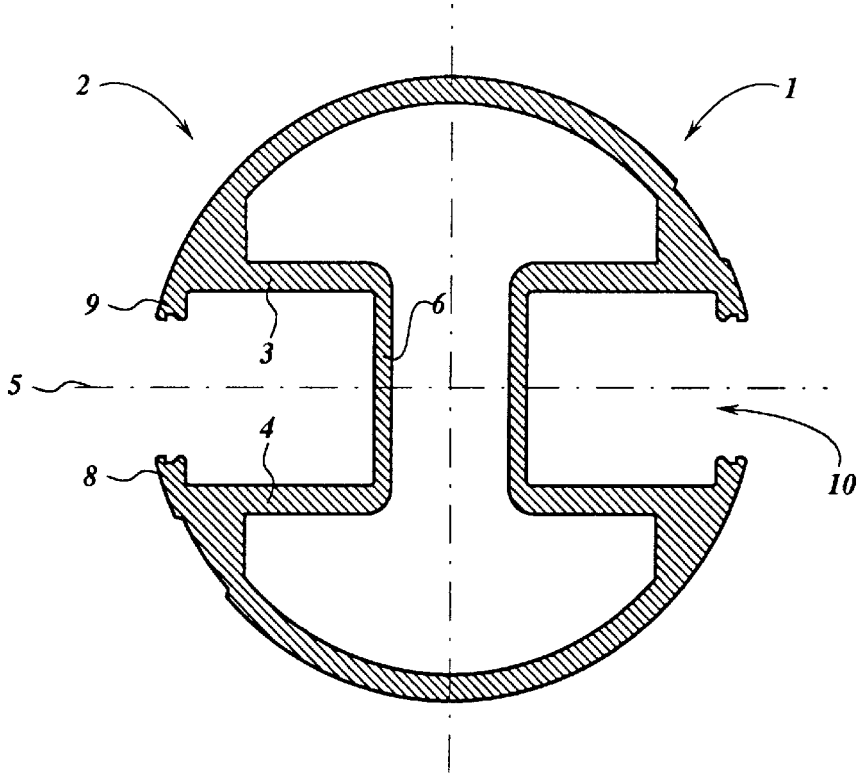
FIG. 2 shows the cross-sectional profile of the post.

In this embodiment the game net post has a fixed length and therefore comprises a one part post section 1. The cross-sectional profile of the post section 1 is shown in FIG. 2. It is hollow with a substantially circular outer circumference 2. A pair of webs 3, 4, extending parallel to each other and parallel to one diametrical line 5, interconnected by a web 6 perpendicular to webs 3 and 4 all integrally formed with the remainder of post 1, create a cavity 7 which, at 8, is open to the outside. The spacing between webs 3 and 4 is somewhat bigger than the width of opening 8, so that there are two protruding portions 9.

A similar cavity 10 is provided on the opposite side, although this is only used when a post is utilized at the border line of two adjacent playing fields, so that two game nets are to be arranged on one post.

Figure 3:
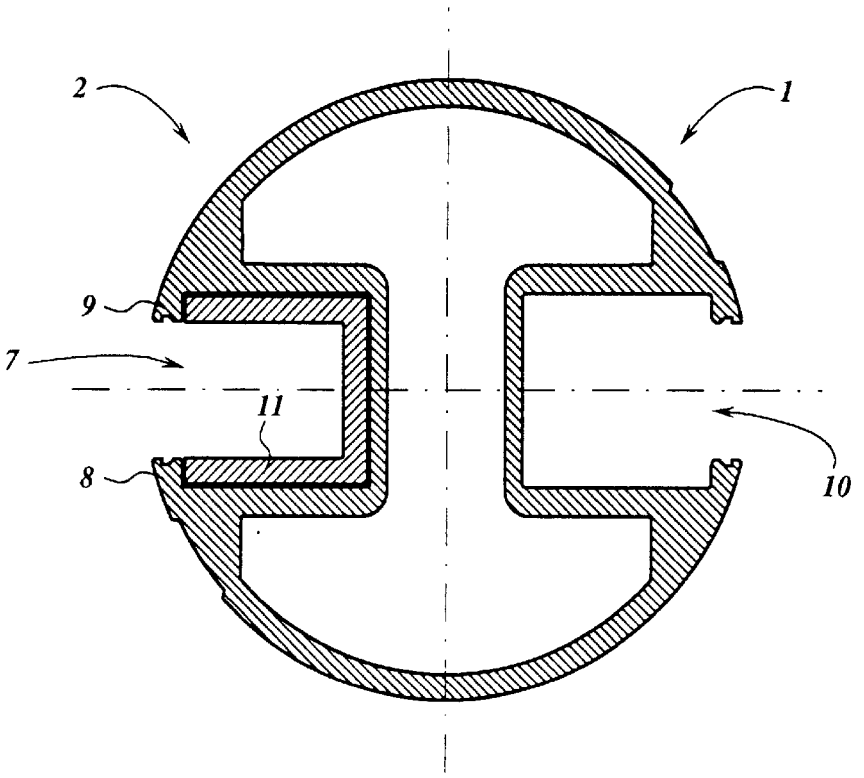
FIG. 3 is a cross-sectional view according to the arrows III—III in FIG. 1.

Each of cavities 7 and 10 may serve to accomodate a longitudinal member 11, indicated in broken lines in FIG. 1, and the cross-sectional profile of which, in this embodiment, is shown in FIG. 3. It is slideable lengthwise in cavity 7 or 10. In this embodiment, where the cross-section of cavities 7, 10, 11 is rectangular, it is a section with a U-shaped profile. Its outer circumference substantially corresponds to the inner circumference of the webs creating cavity 7, and protruding portions 9 confine it within the cavity, allowing relative longitudinal displacement but no relative radial displacement by which longitudinal member 11 would leave cavity 7.

The length of U-shaped longitudinal member 11 is indicated by L in FIG. 1; it is seen to be less than the overal length of the post 1. By means yet to be described, member 9 may be slid up and down and thereupon fixed, by means also yet to be described, in the desired vertical position corresponding with the required net height for each game.

The longitudinal member 11 which is situated interiorly and is therefore represented in broken lines in FIG. 1, is shown in itself and at a larger scale in FIG. 4, which is composed of FIG. 4A representing the top part, FIG. 4B representing the middle part and FIG. 4C representing the bottom part of longitudinal member 11. Moreover FIG. 5, shown on top of FIG. 4A, represents, at the same scale, the top view of longitudinal member 11 without the parts affixed to it, showing its profile which in this embodiment is a U-section, as was disclosed already with reference to FIG. 3.

All the way at the top a nylon block 13, which is fitted within U-section 11, is fixed to said section by means of two spring pins 14, 15 arranged through aligned boreholes in the side webs 16, 17 of U-section 11. Spring pins are commercially available fixation means, comprising a high carbon steel pin which presents a longitudinal slit by which it returns resiliently outwards after having been placed by some force into a hole of appropriately choosen diameter.

Nylon block 13 carries, at the location of the opening between side webs 16, 17, a U-shaped bracket 18 which serves to support a guide roller 19. Guide roller 19 presents a circumferential groove 20, particularly visable from FIG. 6 which is a horizontal cross-sectional view according to the arrows VI—VI in FIG. 4A. Thus guide roller 19 serves to guide, in groove 20, cable 21 from which net 22 is suspended and tensioned as diagrammatically shown in FIG. 1.

The vertical dimension or height of nylon block 13 is somewhat bigger than would be necessary to carry roller carrying bracket 18. In the bottom of block 13 a blind bore-hole 23 is made (see FIG. 4A) serving as a bearing for the top end of wire shaft 24.

FIG. 7 is a cross-sectional view further down U-section 11, see FIG. 4*b*. Wire shaft 24 extends through a running nut 25, circumferential flats preventing its rotation inside section 11. Nut 25 carries a hook 26 which, at least with its inclined downwardly directed hook end 26' projects outside the outer circumferential surface 2 of post 1. U-shaped hook 26' has the function that an eyelet 21' at the end of net cable 21 (see again FIG. 1) may be attached to it. When wire shaft 24 is rotated—by an action yet to be described—running nut will run up and down. In its downward movement, net cable 21 will be tensioned, and in its upwards movement the tension will be taken away again so that the cable eyelet 21' may be unhooked.

It is preferred that the thread profile of wire shaft 24 and the associated inner thread profile of running nut 25 are of the trapezium type, which allows a higher pitch value than thread of triangular cross-section will do.

Again further down another nylon block 27 is fixed within U-section 11 in similar manner as is decribed above, i.e. by means of two spring pins 28, 29 which are put between aligned boreholes in the side webs of section 11 as well as in nylon block 27.

The lower end 30 of wire shaft 24, from which thread has been removed so that only its core diameter remains, extends through appropriate vertical bore 31 in block 17. Because the thread of shaft 24 has a greater diameter than bore 31 wire shaft 24 remains rotatable in said bore but downward movement is prevented.

Below block 27 a double universal coupling 22 forms the connection between the lower end 30 of wire shaft 24 and a three-part cranked handle 33. FIG. 4B shows this handle 33 in its non-operative state, hanging down inside U-section 11, and FIG. 1 shows handle 33 in an active position. Thus, by manually operating upon handle 33 it is possible to rotate wire shaft 24 in one sense or the other so as to move running nut 25 up or down and creating tension in net cable 21 or removing tension therefrom, as described.

Beyond the extreme end of handle 33 a further nylon block 34 is fixed within U-section 11, by means of a pair of spring pins 35, 36 in the same manner as described earlier. Block 34 carries a well known clam cleat 37. This clam cleat serves, as is known in this art, as an attachment means for a rope 38 (see FIG. 1) which is the lower rope of net 22.

Nylon block 34 has a somewhat smaller horizontal dimension than the other nylon blocks discussed above, so that clam cleat 37 is partially recessed in U-section 11. It projects from the circumferential surface 2 of post 1 only in so far as is necessary to properly attach lower net rope 38.

Again below the clam cleat a handle 39 has been fixedly attached, such as by welding, to a cilindrical piece 40 which is rotatable around pin 41. Pin 41 is arranged aligned bore holes in side webs 16, 17 of U-profile 11 and a throughgoing bore in cilindrical piece 40 at a place which is eccentric with respect to the circular circumference of part 40, as will be particularly clear from FIGS. 8A and 8B.

In the position shown in FIG. 4*c* the place having the greatest radius extends through an aperture 42 in the rear web of U-section 11 so that at that place it is able to contact the rear web 6 (see FIG. 2) of the cavity 7 in post 1. A clamping effect for fixation of the height position of U-section 11 with respect to post 1, is created when handle 39 is brought from a horizontal, non-clamping position 39' (see FIG. 1) into the vertical position 39 shown in FIGS. 1 and 4C.

When guide roller 19, running nut 25, block 27 carrying wire shaft 24 with cranked handle 33, clam cleat 37 and clamping handle 39 have all been mounted into and have been fixed to U-section 11, clamping handle 39 is put into the non-clamping or open position 39', and then U-section 11 is slid from either one of the ends of post 1 into one of cavities 7 or 10 of post 1. Thereupon they are temporarily immobilized by bringing handle 39 into its clamping position in which the post is ready for transport and for use.

For actual use, clamping handle 39 is freed again and U-section 11 is arranged into an exact vertical position with respect to post 1 so as to obtain the desired height of net 22 above the ground. Then clamping handle 39 is swung down again so as to immobilize U-section 11 with all the parts carried by it with respect to post 1. Finally, in the manner known in itself, net 22 is attached to the post by means of cable 21 and rope 38. Then, after having taken cranked handle 33 out of the post, it is rotated so as to obtain tensioning of net cable 21 in the manner described.

With respect to this first preferred embodiment shown and described, it will now also have become clear that the rectangular inner profile of cavities 7 and 10, and the corresponding rectangular, or in this case even square cross-section of U-profile 11 are not indispensable to obtain the advantages which the invention strives for. Cavities 7 and 10 as well as longitudinal member 11 may as well have a substantially circular or oval or elliptical shape, provided that means such as 9 bound opening 8 which prevents longitudinal member 11 from leaving the cavity in a radial direction, particularly under the influence of net tension in net cable 21 or lower net rope 38.

Furthermore it will be understood that functional elements such as guide roller 19, hook 26, cable tensioning means 24, 27, 33, clam cleat 37 and clamping handle means 39, 40 can not only be affixed to longitudinal member 11 in different manners than those described, but may in themselves also have different structures than those which the present inventor prefers.

Now, with reference to FIGS. 9–11, a second preferred embodiment will described. This is a two-part, height-adjustable post, comprising a lower part 51 and an upper, slideable part 52.

Lower post part 51 is, in use, placed into a ground pot just like post 1 of the first embodiment; also it may have, as is preferred exactly the same cross-sectional profile as post 1 in the first embodiment (shown in FIG. 2). Upper post part 52 has been specially designed for this embodiment but it cross-sectional profile is shown on a larger scale in FIG. 10. FIG. 11 shows the relationship thereof with the cross-sectional profile of lower post part 51, which, as said, is identical to the profile of post 1 in FIG. 3, and the relationship to longitudinal member 53 which is also identical to longitudinal member 11 of the first embodiment, shown in FIG. 3.

From FIG. 11 it will be clear that the profile of upper post part 52 follows substantially the entire internal space left in the cross-section of the lower post part profile after the provision of the two cavities 7 and 10. The outer circumference is part-circular at 54 and 55, integral with inwardly directed webs 56 and 57 which, in turn, are pairwise interconnected by a rear web such as 58. Two rear web such as 58, each lying at some distance from the diagonal line 59, are interconnected, for reasons of stiffness and stability, by a bridge part 60. One may say that webs 56, 57, 58 again constitute a cavity such as 61, somewhat bigger than and surrounding cavities 7 and 10.

Longitudinal member 53 may be identical to longitudinal member 11 in the first embodiment, not only in its cross-sectional shape but also in the fact that it carries (see FIG. 11) guide roller 62, running nut 63 with hook 64 cranked handle 65 for rotating wire shaft 66, clam cleat 67 and clamping handle 68.

Even in the lowermost position of upper post part 52—which is the position represented in FIG. 9—it projects a certain distance above the top, indicated by 69, of lower post part 51. FIG. 9 shows that longitudinal member or U-section 53 extends all the way to the top 70 of upper post part 52. On the other hand member 53 is longer than the height over which upper post part 52 projects above top 69 of lower post part 51, so that part of U-section 53 is situated within cavity 7 in lower post part 51. In the latter part there is a fitting relationship between the longitudinal member and the cavity, but from FIG. 11 it appears that there is a certain clearance or spacing, indicated by 71, between the rear web 72 of U-section 53 and rear web 73 of cavity 61 in upper post part 52. This is taken up by a filling strip 74 (FIG. 9), which is arranged all the way at the top, behind support bracket 75 for guide roller 62. Behind guide roller support bracket 75, U-section 53 can be affixed to rear web 73 by known means such as rivets, interposing filling strip 74. The result will be that longitudinal member 53 and upper post part 52 will move up and down together.

The height position of upper post part 52 with longitudinal member 53 attached to it with respect to lower post part 51 can be adjusted as desired so as to obtain a series of different net heights as prescribed by the regulations. Upper post part 52 is clamped in the selected height position by clamping handle 68, which immobilizes longitudinal member 53 with respect to lower post part 51.

FIG. 9 finally, schematically shows a compression spring mechanism 76 which compensates the weight of upper post part 52 and all the parts affixed to. This is no part of the present invention, however; to the contrary it is the subject of applicant's U.S. Pat. No. 5,308,085.

What is claimed is:

1. A game net post comprising, in combination:

a post adapted to be placed in a substantially vertical position in the ground or floor;

mechanism for attaching a net to the post and tensioning the same in a net playing position;

the cross-sectional profile of the post presenting a cavity opening outwardly toward a net attached to the post in a net playing position; and the cross-sectional dimensions of the cavity being such that the net attaching and tensioning mechanism is substantially completely housed within the cavity.

2. A game net post as in claim 1 wherein, in said cavity, a longitudinal member is inserted which is slideable inside said cavity, means being provided, to prevent said longitudinal member from leaving the cavity in radial direction with respect to the post, and means to immobilize said longitudinal member in longitudinal direction with respect to the post, and said longitudinal member having affixed to it the net cable tensioning means.

3. A game net post as in claim 1 wherein, in said cavity, a longitudinal member is inserted which is slideable inside said cavity, means being provided to prevent said longitudinal member from leaving the cavity in radial direction with respect to the post, and means to immobilize said longitudinal member in longitudinal direction with respect to the post, and said longitudinal member having affixed to it means carrying a wire shaft and a handle coupled to said wire shaft, adapted to rotate the wire shaft while avoiding the longitudinal displacement thereof, a running nut with hook means being associated with said wire shaft.

4. A game net post as in claim 1 wherein, in said cavity, a longitudinal member is inserted which is slideable inside said cavity, means being provided to prevent said longitudinal member from leaving the cavity in radial direction with respect to the post and means to immobilize said longitudinal member in longitudinal direction with respect to the post, and said longitudinal member having affixed to it means carrying a wire shaft and a handle coupled to said wire shaft, adapted to rotate the wire shaft while avoiding the longitudinal displacement thereof, a running nut with hook means being associated with said wire shaft, and said longitudinal member having further affixed to it net cable guide means.

5. A game net post as in claim 1 wherein, in said cavity, a longitudinal member, the outer profile of which substantially corresponds with the inner cross-sectional profile of said cavity, is slideably inserted, means being provided to immobilize said longitudinal member with respect to the post, and said longitudinal member having affixed to it net cable tensioning means.

6. A game net post as in claim 1 wherein said cavity is substantially rectangular in cross-section.

7. A game net post as in claim 1 wherein the cross-sectional profile of the post presents two such cavities, lying substantially diametrically opposite one another in the post profile, the second cavity to receive net attaching and tensioning mechanism similar to that received and substantially housed in the first mentioned cavity.

8. A two-part height-adjustable game net post adapted to be placed in substantially vertical position into the ground or floor, said post parts having cross-sectional profiles such that the second one is slideable within the first one of said parts, means being provided to immobilize the two parts in a position corresponding to a selected net height, the cross-sectional profile of each of said post parts presenting a cavity, open to the outside, and having cross-sectional dimensions such that the net cable tensioning means may be received in it.

9. A two-part game net post as in claim 8, wherein, in said cavities, a longitudinal member is inserted which is affixed to one post part and is slideable within the cavity in the other post part, said longitudinal member having affixed to it the net cable tensioning means.

10. A two-part game net post as in claim 8, wherein, in said cavities, a longitudinal member is inserted which is affixed to one post part and is slideable within the cavity in the other post part, said longitudinal member having affixed to it the net cable tensioning means, means being provides to prevent said longitudinal member from leaving the cavity in said other post part in radial direction with respect to the post part.

11. A two-part game net post as in claim 8, wherein, in said cavities, a longitudinal member is inserted which is affixed to one post part and is slideable within the cavity in the other post part, said longitudinal member having affixed to it means carrying a wire shaft, adapted to rotate the wire shaft while avoiding the longitudinal displacement thereof, a running nut with hook means being associated with said wire shaft.

12. A two-part game net post as in claim 8, wherein, in said cavities, a longitudinal member is inserted which is affixed to one post part and is slideable within the cavity in the other post part, said longitudinal member having affixed to it means carrying a wire shaft, adapted to rotate the wire shaft while avoiding the longitudinal displacement thereof, a running nut with hook means being associated with said wire shaft, and said longitudinal member having further affixed to it net cable guide means.

13. A two-part game net post as in claim 8 wherein, in said cavity in the first one of the post parts, a longitudinal member, the outer profile of which substantially corresponds with the inner cross-sectional profile of said cavity, is slideably inserted, said longitudinal member being affixed, interposing a filling member, to the second post part inside the cavity therein, and said longitudinal member having affixed to it net cable tensioning means.

14. A two-part game net post as in claim 8, wherein said cavities are substantially rectangular in cross-section.

* * * * *